United States Patent [19]

Fuerschbach

[11] Patent Number: 4,815,534

[45] Date of Patent: Mar. 28, 1989

[54] PLATE TYPE HEAT EXCHANGER

[75] Inventor: Raymond F. Fuerschbach, Tonawanda, N.Y.

[73] Assignee: ITT Standard, ITT Corporation, New York, N.Y.

[21] Appl. No.: 99,250

[22] Filed: Sep. 21, 1987

[51] Int. Cl.[4] ..... F28F 3/08

[52] U.S. Cl. ..... 165/167; 165/166

[58] Field of Search ..... 165/166, 167

[56] References Cited

U.S. PATENT DOCUMENTS

| | | | |
|---|---|---|---|
| 2,360,123 | 10/1944 | Gerstung et al. | 165/166 |
| 2,939,686 | 6/1960 | Wildermuth | 165/167 |
| 3,079,994 | 3/1963 | Kuehl | 165/166 |
| 3,783,090 | 1/1974 | Anderssen et al. . | |
| 3,792,730 | 2/1974 | Anderson | 165/167 |
| 3,807,496 | 4/1974 | Stadmark | 165/167 |
| 3,809,156 | 5/1974 | Anderson | 165/167 |
| 4,002,201 | 1/1977 | Donaldson | 165/166 |
| 4,006,776 | 2/1977 | Pfouts et al. | 165/166 |
| 4,011,905 | 3/1977 | Millard | 165/175 |
| 4,049,051 | 9/1977 | Parker | 165/166 |
| 4,073,340 | 2/1978 | Parker | 165/166 |
| 4,081,025 | 3/1978 | Donaldson | 165/167 |
| 4,270,602 | 6/1981 | Foster | 165/167 |
| 4,307,779 | 12/1981 | Johansson et al. | 165/166 |
| 4,327,802 | 5/1982 | Beldam | 165/166 |
| 4,347,896 | 9/1982 | Rosman et al. | 165/166 |
| 4,359,087 | 11/1982 | Johansson | 165/167 |
| 4,373,579 | 2/1983 | Jungvist et al. | 165/167 |
| 4,376,460 | 3/1983 | Skoog | 165/167 |
| 4,398,596 | 8/1983 | Lauro et al. | 165/167 |
| 4,402,362 | 9/1983 | Dubrovsky | 165/166 |
| 4,403,652 | 9/1983 | Schiltz et al. | 165/167 |
| 4,407,359 | 10/1983 | Berger et al. | 165/167 |
| 4,423,772 | 1/1984 | Dahlgren | 165/166 |
| 4,487,038 | 12/1984 | Iijima | 165/166 |
| 4,501,321 | 2/1985 | Real et al. | 165/166 |
| 4,503,908 | 3/1985 | Rosman et al. | 165/167 |
| 4,561,494 | 12/1985 | Frost | 165/167 |
| 4,569,391 | 2/1986 | Hulswitt | 165/166 |
| 4,574,878 | 3/1986 | Sugiyama et al. | 165/166 |
| 4,579,172 | 4/1986 | Carlsson | 165/167 |
| 4,586,565 | 5/1986 | Hallstrom et al. | 165/167 |
| 4,589,480 | 5/1986 | Dahlgren | 165/166 |
| 4,605,060 | 8/1986 | Anderson et al. | 165/166 |
| 4,609,039 | 9/1986 | Fushiki | 165/166 |
| 4,612,982 | 9/1986 | Grehier et al. | 165/166 |
| 4,614,231 | 9/1986 | Proctor et al. | 165/153 |
| 4,616,695 | 10/1986 | Takahashi et al. | 165/166 |
| 4,653,581 | 3/1987 | Yogo et al. | 165/167 |

*Primary Examiner*—Carroll B. Dority, Jr.
*Attorney, Agent, or Firm*—Menotti J. Lombardi

[57] ABSTRACT

A plate heat exchanger in which the various plates from which it is fabricated are brazed together in a stacked assembly comprised of flow plates and heat transfer plates arranged in alternating relationship. The heat exchanger has inlets and outlets for two fluids with passage networks extending between the inlets and outlets and turbulator members are located in each flow cavity formed between adjacent surfaces of the heat transfer and flow plates. The turbulator members are interchangeably positionable between each pair of adjacent flow and heat transfer plates and are selectable from a plurality of differently configured turbulator members. Plate sizes, shapes and openings therein are standardized to provide a basic heat exchanger system which can be fabricated in easily modified embodiments to meet various and diverse heat exchange requirements.

33 Claims, 3 Drawing Sheets

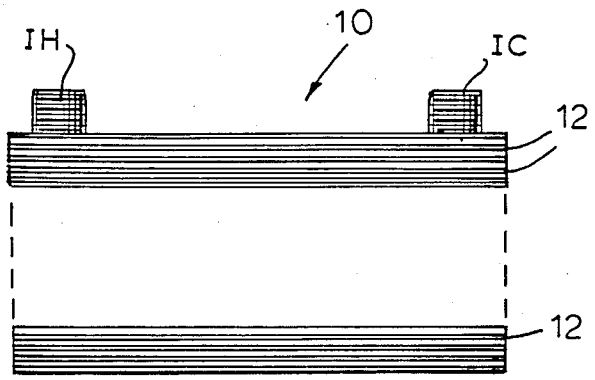
Fig. 1
Fig. 3
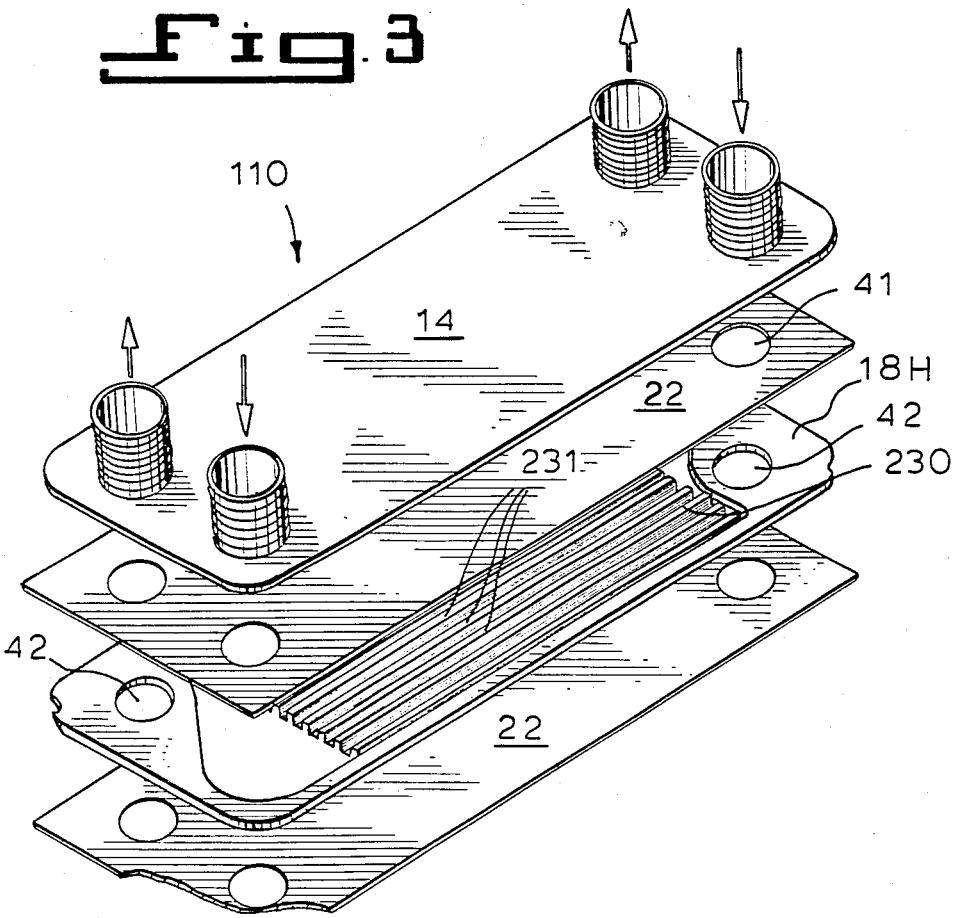

Fig. 7
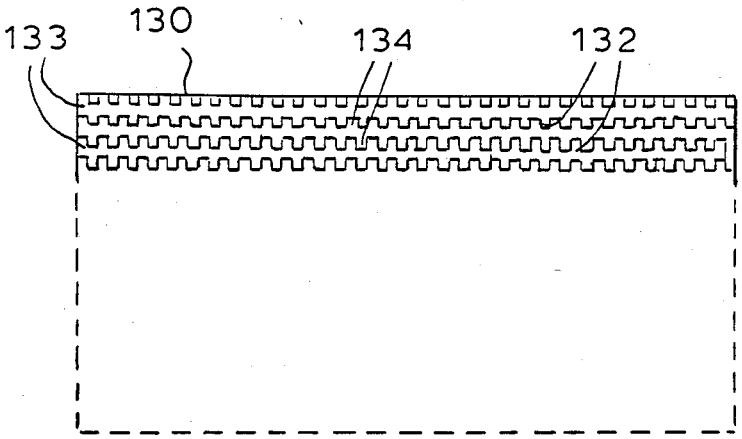
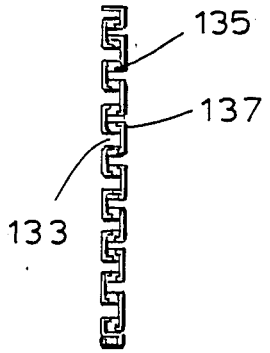
Fig. 8
Fig. 9
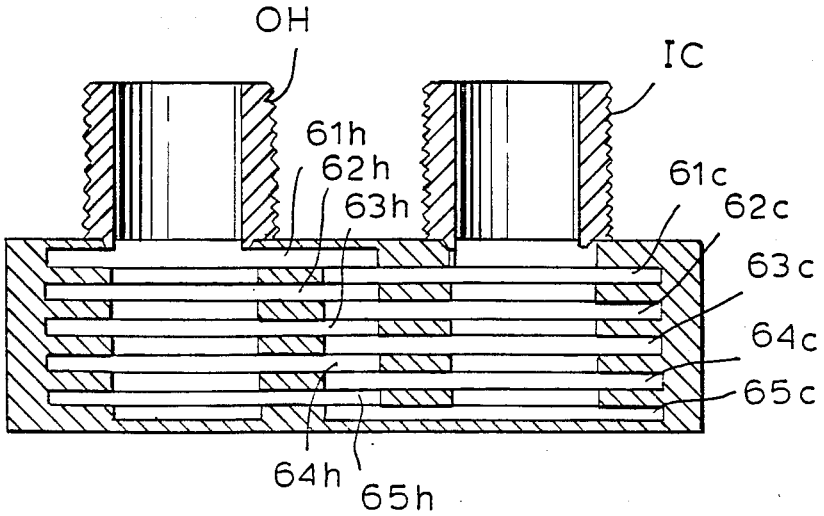

PLATE TYPE HEAT EXCHANGER

BACKGROUND OF THE INVENTION

Plate-type heat exchangers are being more widely used for certain industrial applications in place of fin and tube or shell and tube type heat exchangers because they are less expensive and easier to make than most forms of heat exchangers. In one form of such plate exchangers, a plurality of plates are clamped together in a stacked assembly with gaskets located between adjacent plates and traversing a course adjacent to the plate peripheries. Flow of the two fluids involved in heat exchange is through the alternate ones of the layers defined by the clamped plates.

The stacked plates also can be joined together as a unitary structure by brazing the various components together. U.S. Pat. No. 4,006,776 discloses a plate heat exchanger made in such manner. U.S. Pat. No. 4,569,391 discloses a plate heat exchanger in which plural parallel spaced plates are welded together. The space between plates is occupied by nipple-like protuberances formed in the plates and which serve to increase turbulence in the fluid flow. All of the fluid flowing in a given defined space is in contact with the plates to thereby enhance heat transfer.

U.S. Pat. No. 4,561,494 also discloses employment of a turbulator, i.e., a turbulence producing device, in a plate heat exchanger. U.S. Pat. No. 4,398,596 discloses another construction of a plate heat exchanger in which spaced rectangular-shaped plates define a succession of fluid flow passages, the alternate ones of which are associated with the flow of the two fluids involved in heat exchange. The plates have four orifices located at the four plate corners. Two of these orifices are associated with one fluid flow and the other two with the second fluid flow. The orifices are aligned with tubular passages leading to the various fluid flow passages.

While plate heat exchangers of known construction and as exemplified in the aforementioned U.S. Patents, have the advantage of being less complicated and more easily fabricated than fin and tube types, they employ components that involve unnecessary assembly steps or possess shapes that entail undesirable shaping procedures. Further, they require maintaining a components inventory that could be reduced if a more simplified plate heat exchanger construction optimizing standardized components usage was provided. With a standardized system, it would be possible to provide a stacked plate exchanger that could be produced economically and efficiently on demand with a variety of different interchangeable structures to satisfy a wide variety of needs.

SUMMARY OF THE INVENTION

An object of the present invention is to provide a plate type heat exchanger which is easily, economically and efficiently fabricated. For such purpose, plate components of simple structural character are employed thereby reducing the need for special components shaping devices and stocking of a multiplicity of different shaped elements.

Another object is to provide a plate heat exchanger having heat transfer cells which can be embodied in a compact heat exchanger structure in a given fluid cooling capacity for a wide range of industrial and/or commercial applications.

A further object is to provide a plate heat exchanger which is particularly suited for ready incorporation therein of any one or combinations of differently configured flow turbulator members for most efficiently matching the turbulator used to the characteristics and flow properties of the various fluids for which a heat exchanger is used.

In accordance with the invention, the plate heat exchanger is a brazed together unitary, elongated generally rectangular-shaped structure comprising a stacked assembly of substantially flat coextensive and superposed plates. The stacked assembly will, depending on particular heat transfer requirements, include at least one but most usually a plurality of heat transfer cells. It will be understood that a "cell" is constituted by two adjacently placed or alternating flow cavities in the assembly and wherein respective heated and cooling fluids flow.

The plate heat exchanger comprises a plurality of flow plates and a plurality of heat transfer plates arranged in an alternating stacked relationship with one another so that flow cavities are formed between the adjacent surfaces of the heat transfer and flow plates. A turbulator member is positioned in each flow cavity and it can be one of a plurality of differently configured turbulator shapes that can be employed interchangeably in any one of the heat exchanger cavities. The flexibility of being able to utilize any one or several of the differently configured turbulator members in the heat exchanger is a major advantage of the invention. It allows utilization of a standardized heat exchanger construction and fabrication procedure with simple modification thereto effected by utilizing any one or combination of freely selectable turbulator shapes to produce a heat exchanger specially adapted for a given cooling requirement and type of fluid.

The heat exchanger has an inlet and outlet for a first fluid and there is a passage network therebetween with the passage network being comprised of various network defining structure, e.g., openings, being present in the flow and heat transfer plates. A similar inlet and outlet and passage network arrangement is provided for a second fluid. Each turbulator member is located in the passage network of one of the fluids with the network so arranged that there is heat transfer between the fluids passing therethrough. The stacked plates and turbulators are sealingly interconnected to form them together in unitary structure form and the assembly can be provided with top and bottom plates. Where the assembly is interconnected by brazing, a thin braze alloy sheet can during assembly, be intervened between the alternating plates and following subjection of the assembly to a heated brazing environment, the braze alloy sheets will form alloy layers adhering to adjoining faces of the plates and also fluid-tightly seal the peripheral regions of the plate interfacings.

The plates from which the heat exchanger is fabricated are such as to standardize as much as possible the shape, dimension, types of material and the like. This makes manufacturing as convenient and economical as possible yet allows great latitude in fabrication of a line of heat exchangers from a single basic design. For example, the plates and braze alloy sheets can be of generally flat rectangular shape and substantially the same dimension. Additionally, the flow and top and bottom plates can be of uniform and the same thickness, while the heat transfer plates will be of lesser thickness. Also the openings in the plates which define the passage networks are standardized as to location and size and the flow plates have a single configuration so that alternately arranged ones in the assembly have reversed orientation to alternately communicate the flow cavities to the respective two fluid passage networks. Further the turbulator members have a single size that allows their interchangeable reception in flow course openings in any of the assembly flow plates.

The turbulator members serve to present tortuous flow courses within the flow plates. This causes fluid turbulence flow conditions in the cavities such that film buildup on heat transfer surfaces as would materially effect desirable film coefficient values is avoided. Also, heat transfer is enhanced by exposing as much as possible the fluid to adjacent heat transfer surfaces. These turbulator members as noted can be of identical or different configuration. In one form, the turbulator members can be a grid of parallel rows of upstanding projections, i.e., be an alternating arrangement of peaks and valleys. The projections have alternately arranged at the sides thereof, a succession of laterally projecting abutment wings which present flow barriers requiring that striking fluid divert into openings at the sides of the wings to obtain on-flow access within the cavities. The rows of projections can be disposed either crosswise to or longitudinally of the flow cavities. The turbulator member projections can in another form, be of inverted channel section.

Because of the configurations of turbulators which can be selected for use in the heat exchanger, the turbulators can serve an additional important function in that they can constitute an extended heat transfer surface in each heat transfer cell thereby to increase the heat transfer capabilities of the heat exchanger for given heat exchanger dimensions. Increased heat transfer surface presence for a given heat exchanger cell dimension of as much as 40% or more is possible.

The heat exchanger can be used for cooling of and with various types of gases and liquids inclusive of air, refrigerants, lubricants, water etc. It possesses excellent heat transfer characteristics providing large heat transfer surface with minimized space requirements. Of particular advantage is that both hot and cold fluids can develop good film coefficients with overall coefficients two or three times those of shell and tube type heat exchangers.

The invention accordingly comprises the features of construction, combination of elements and arrangements of parts and steps as embodied in a heat exchanger which will be exemplified in the construction thereof and method for fabrication as hereinafter set forth and the scope of the invention will be indicated in the claims.

BRIEF DESCRIPTION OF THE DRAWINGS

The invention will appear more clearly from the following detailed description taken in conjunction with the accompany drawings in which:

FIG. 1 is a side elevational view on reduced scale of a plate heat exchanger constructed in accordance with the principles of the present invention, the depicted embodiment being comprised of a plurality of heat transfer cells;

FIG. 3 is an exploded perspective view of a portion of a heat exchanger like that of FIG. 2 showing another turbulator configuration which can be used in the heat exchanger flow cavities;

FIGS. 7 and 8 are respective fragmentary plan and right end elevational views of the turbulator member shown in FIG. 4; and FIG. 9 is a vertical sectional view on enlarged scale of the heat exchanger shown in FIG. 1 as taken along the cutting line IX—IX in FIG. 1, the embodiment shown being of a heat exchanger having five heat transfer cells.

Throughout the following description, like reference numerals are used to denote like parts in the drawings.

DESCRIPTION OF THE PREFERRED EMBODIMENTS

Figure 2:
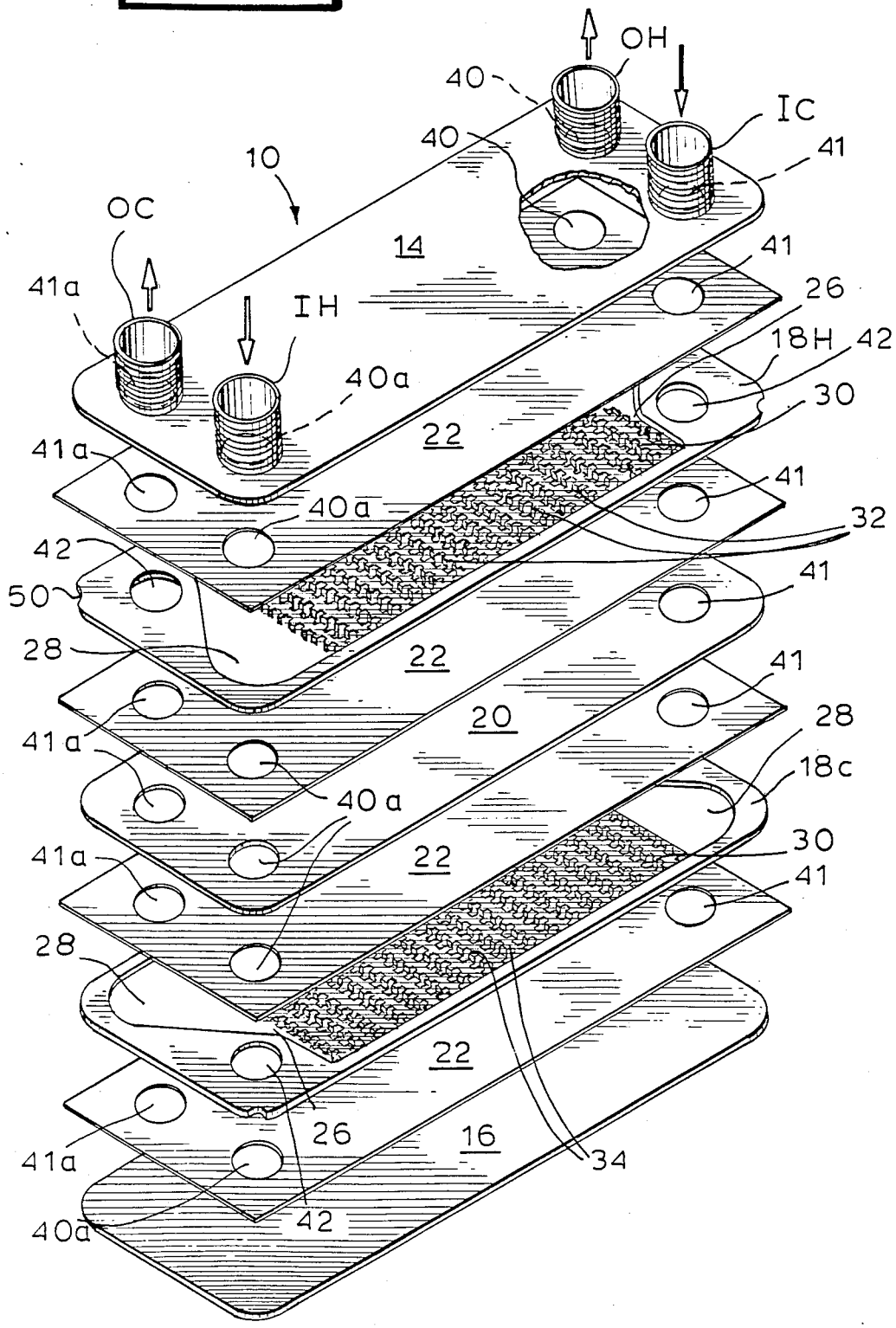
FIG. 2 is an exploded perspective view of a heat exchanger of the type shown in FIG. 1 but embodying only a single heat transfer cell therein, the turbulator members positioned in each of the flow cavities being of identically shaped configuration.

Referring to FIG. 1, there is depicted a plate heat exchanger 10 of the stacked plate type and which includes therein heat transfer cells 12 comprising in number as little as one and as many as fifteen cells, the cells each presenting heat exchange flow paths for a heated fluid and for a cooling fluid. FIGS. 2 and 3 illustrate the basic constructional makeup of the heat exchanger and as same incorporates but a single heat transfer cell. The arrangement of parts seen in FIGS. 2 and 3 are simply correspondingly duplicated in plural presence where it is desired to fabricate a plural heat transfer cell heat exchanger of greater heat exchanger capacity, e.g., the five heat transfer cell unit shown in FIG. 9.

Referring now to FIG. 2, heat exchanger 10 is comprised of elongated generally rectangular-shaped, flat plate members. The plate members stack in superposed relation one on the other and include a top plate 14, a bottom plate 16, the two flow plates 18H and 18C and heat transfer plate 20 which three plates together constitute a heat transfer cell 12. Braze alloy sheets 22 are shown intervening the top, bottom, flow plates and the heat transfer plate. These sheets are inserted in the stack during fabrication and provide the brazing alloy source material for joining together the unassembled plates.

Each flow plate 18H, 18C with the alternating heat transfer plate 20 defines a fluid flow course or flow cavity (the top and bottom plates in this respect also being heat transfer plates). The flow plates each have an elongated laterally widened flow course opening 26, such opening having diagonally disposed extensions as at 28 at its opposite ends, these extensions constituting flow inlet and outlet points communicating the defined flow cavity with a flow passage network as shall be described later. Disposed within each opening 26 is a turbulator member 30, the turbulator member having substantially regular plan outline and being sized to be slightly shorter than the run of the flow course opening 26 between its two end extensions 28. The turbulator member is of predetermined configuration selected from a plurality of different turbulator configurations available and related to type of fluid used therewith etc. and serves to present obstruction to flow within plates 18H, 18C thereby causing creation of irregular and random fluid flow currents. This effect is to enhance heat transfer from or to the fluid flowing in the cavity. In this regard and by reason of the particular finned turbulator configurations from which selection is made as well as the fact that the turbulator is connected in the assembly to the heat transfer plate, the turbulator additionally serves as an extended heat transfer surface so that the total heat transfer surface of the cell is considerably greater (for a given cell physical dimension) than that possible with prior types of heat exchangers.

Figure 5:
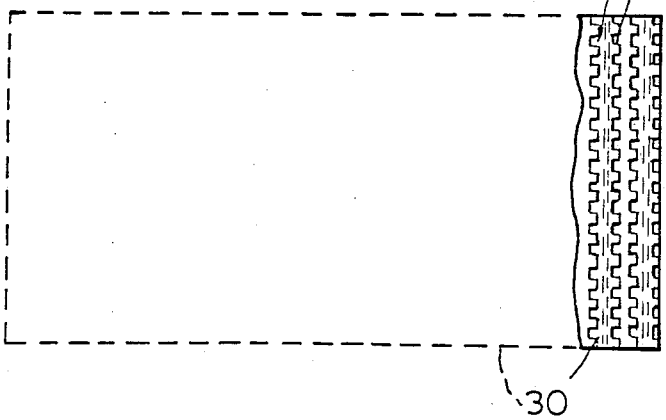
FIGS. 5 and 6 are respective fragmentary plan and right end elevational views of the turbulator members employed in the FIG. 2 heat exchanger.
Figure 6:
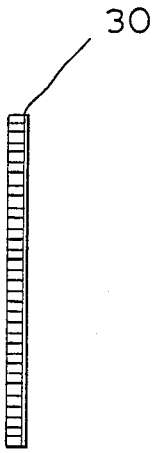

The turbulator member 30 details of which are also shown in FIGS. 5 and 6, is a grid comprised of a plurality of parallel spaced rows 32 of upstanding projections, i.e., the grid presents alternating peaks and valleys which peaks and valleys will be, in the finished heat exchanger, secured or connected to the adjoining heat transfer plates by a braze alloy layer. The projections include a longitudinal succession of laterally directed abutment wings 34, the wings being located alternately at the two opposite sides of each row. The underside of each wing abutment is open and it is these openings which provide flow communication between the spaces or valleys at the two sides of each row. The turbulator can be positioned in the flow plates such that the rows 32 dispose transverse to the major axis or flow plate openings 26 and thereby present maximum abutment confrontation to fluid flowing through the flow plate. In such case, the flowing fluid will be forced to deviate laterally slightly in its course to enter the openings under the wings at one side of each row and also follow slight lateral deviation again to outlet from the wings at the other side of a row. The offset relationship of the wings 34 in each row can be seen with reference to FIGS. 5 and 6.

Figure 4:
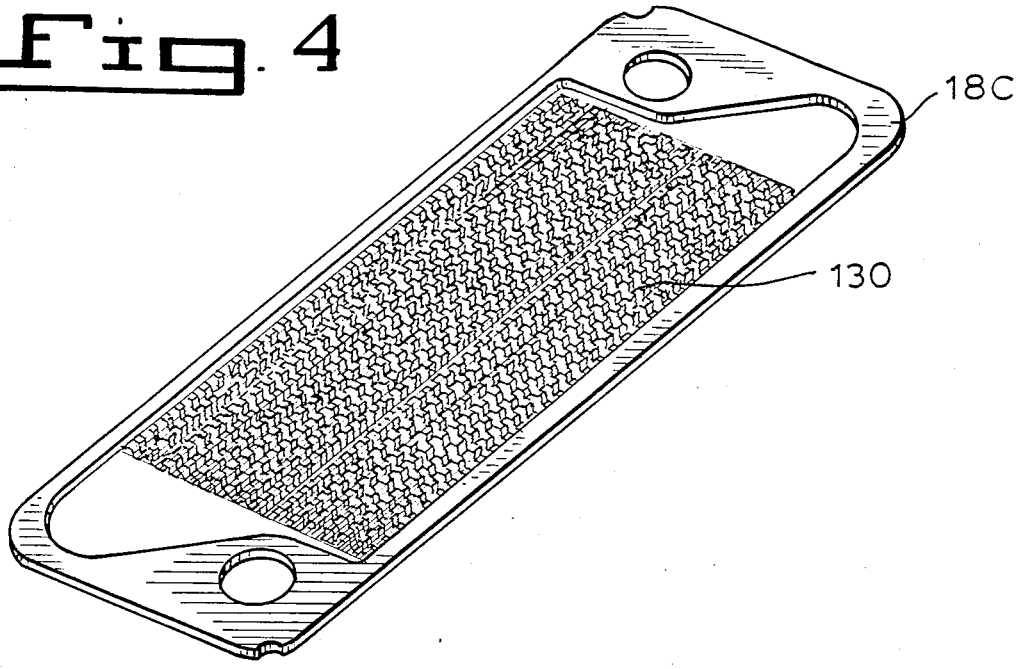
FIG. 4 is a perspective view of another embodiment of turbulator member and depicts further the received positioning of such member in the flow plate that defines its associated flow cavity.

FIGS. 4, 7 and 8 show the same configured turbulator member 130 except in that embodiment, the rows 132 are disposed longitudinally of the flow course opening 26 of the flow course plate. This orientation of the turbulator provides less direct opposition to fluid flow since the wings 134 face crosswise to the flow direction and direct longitudinal flow courses exist in the spaces between the rows as at 133 and where the openings under each of the wings align as at 135, 137. The flow turbulence produced with this orientation is sufficient to effect good heat transfer while at the same time pressure loss through the cell is minimized.

FIG. 2 illustrates how the various plate components can be apertured or provided with openings to establish the two separate fluid flow passage networks present in the heat exchanger. The top plate 14, each braze alloy sheet 22 and heat transfer plate 20 are punched to have identically sized and located openings 40, 41 at an end thereof and a similar pair of openings **40*a* and 41*a* at the other end, the said openings being located each proximate a corner of its associated component. The flow plates 18H, 18C have a pair of diagonally opposed openings 42 which are located alongside of and isolated from the respective flow course extensions 28 in each such plate. With the plates in stacked and brazed assembly, the openings 40, 40*a* of the plates and the extensions 28 of the flow course plate 18H will register to constitute a heated fluid passage network extending between inlet to the heat exchanger defined by top plate opening 40*a* and the outlet defined by the top plate opening 40, the turbulator 30 in the flow cavity defined by flow plate 18H and heat transfer plate 20 and top plate 14 being located in such passage network. Threaded nipples IH and OH are brazed to the top plate and provide means for connecting the heat exchanger to the heated fluid origin. The same arrangement applies to the cooling fluid flow passage network wherein aligned openings 41, 41*a* and extensions 28 in plate 18C** align to constitute the cooling fluid passage network, and it communicates with nipples IC and OC in the top plate. It will be appreciated that a variety of types of inlet and outlet arrangements for fluid flow to and from the heat exchanger are possible.

While the depicted heat exchanger construction involves countercurrent flow between the two fluids in the heat transfer cell, the same structure could also be employed if concurrent fluid flow is desired by simply connecting the inlets and outlets for the two fluids at corresponding ends of the heat exchanger. Various ways to provide multiple passes of either hot or cold side flow will be understood by those skilled in the art.

For fabrication of the heat exchanger no special or costly practice is involved. The bottom, top and flow plates can be of uniform and the same thickness, e.g., 12 gauge carbon or stainless steel plate stock. These plates, in a practical heat exchanger form, can be provided in sizes about $12\frac{3}{8}$ by $4\frac{5}{8}$ inches but in other convenient sizes as well. The various openings in the plates are made in a punching operation. The heat transfer plate can be made from the same carbon or stainless steel material but its thickness will while substantially uniform, be much less than that of the top, bottom or flow plates, e.g., about 1/10 inch. The braze alloy sheets, for example, and as is a common practice to this art, can be base metal with an overall surface cladding of an alloy material of any one of a number of such materials well known to those skilled in the art. The overall thickness of the braze alloy plates need only be several thousands of an inch.

In assembling a heat exchanger, the various plate components will be stacked as shown in FIG. 2, except that if plural heat transfer cells are to be embodied, the required numbers and alternating arrangement of additional flow and heat transfer plates will be used. In placing the plates in the stack, the assembler is guided by the readily visually discernible telltale margin notches 50 in the flow plates 18 so as to alternate these identically configured plates in reversed fashion in the stack to effect proper flow communication of each with its respective heated or cooling fluid passage network. The turbulator members used for a particular heat exchanger will of course depend on a particular use, type of fluid involved and cooling capacity required. The turbulator members will generally be fabricated in the grid shapes shown from carbon or stainless steel stock of about 0.005 to 0.010 inch thickness. The turbulators will have an overall height only slightly less than the thickness of the flow plates and are dimensioned lengthwise to be about 8 inches and have a width of about 4 inches.

When all of the plate components and turbulators as described above have been arranged in stacked assembly, the stack will be clamped and fittings IO, OC, IH and OH will be positioned on the top plate. The assembly will then be placed in an oven or like brazing environment to heat the assembly until the braze alloy sheets become molten sufficiently to effect connection joinder of the components as a unitary structure, with the spaces between the plates having fluid tight seal. Upon cooling, the assembly then is ready for testing and ultimate end use purpose. U.S. Pat. No. 4,006,776 is referred to as an example of a brazing procedure which can be used for this purpose. Other means of interconnecting the components such as welding also could be employed.

The FIG. 3 heat exchanger 110 is much the same as that shown in FIG. 2 except it reflects the use of a differently configured turbulator member. A turbulator member such as that shown in FIG. 2 would be used in one flow cavity of this embodiment whereas, the turbulator in the alternate cavity, i.e., turbulator member 230 would be comprised of a plurality of longitudinally directed parallel spaced fins 231, the turbulator fins each having the shape of an inverted channel member.

FIG. 9 shows how plural heat transfer cells are arranged in the heat exchanger, viz., a five cell unit. The five cells are designated 61–65 and the hot fluid passage networks in each by the letter h and the cold fluid passage networks by letter c.

From the foregoing description it will be understood that variations in the plate heat exchanger construction will occur to those skilled in the art and yet remain within the scope of the inventive concept disclosed.

What is claimed is:

1. A stacked plate heat exchanger comprising:

a plurality of flow plates, each of said flow plates including a flow course opening extending therethrough;

a plurality of heat transfer plates arranged in alternating stacked relationship with said flow plates;

a turbulator member connected to at least one of said heat transfer plates and disposed within one of said flow course openings;

said flow plates, heat transfer plates, and turbulator member each being individual components arranged in said stacked relationship, said heat transfer plates being connected to each adjoining flow plate;

first means for introducing a first fluid into a flow course opening of one of said flow plates;

second means for introducing a second fluid into a flow course opening of another of said flow plates; and fluid outlet means for allowing fluid to exit from each of said flow course openings.

2. The stacked plate heat exchanger set forth in claim 1 further comprising top and bottom plates connected, respectively, to two of said flow plates.

3. The stacked plate heat exchanger set forth in claim 2 including first and second fluid inlets and outlets located in said top plate, said first fluid inlet being in fluid communication with the flow course opening of one of said flow plates, said second fluid inlet being in fluid communication with the flow course opening of another of said flow plates.

4. The stacked plate heat exchanger set forth in claim 3 further comprising connector fittings connected to said top plate and communication each with one of said first and second fluid inlets and outlets.

5. The stacked plate heat exchanger set forth in claim 2 in which the interconnected stacked plates and turbulators are brazed together.

6. The stacked plate heat exchanger set forth in claim 5 in which the stacked plates and turbulator member are each interconnected with one another by a layer of a braze alloy material adhered to the adjoining faces of each and the other plate.

7. The stacked plate heat exchanger set forth in claim 2 in which each of the stacked plates is substantially coextensive with the others.

8. The stacked plate heat exchanger set forth in claim 7 in which the flow, top and bottom plates are substantially uniformly of the same thickness, at least one heat transfer plate being of lesser thickness than said flow, top and bottom plates.

9. The stacked plate heat exchanger set forth in claim 7 wherein each of said plates is of rectangular flat profile.

10. The stacked plate heat exchanger set forth in claim 1 in which the flow plates have elongated laterally widened flow course openings therein.

11. The stacked plate heat exchanger set forth in claim 10 in which the flow course openings of the flow plates have extensions communicating with one of said first and second fluid introduction means.

12. The stacked plate heat exchanger set forth in claim 11 in which the flow plates are of a single configuration whereby alternately arranged ones thereof are positioned in the assembly in reversed orientation to alternately communicate the flow course openings to the first and second fluid introduction means.

13. The stacked plate heat exchanger set forth in claim 1 including a turbulator member within each of said flow course openings for enhancing fluid contact with the heat transfer plates.

14. The stacked plate heat exchanger set forth in claim 13 in which the turbulator members positioned in the flow course openings are of the same configuration.

15. The stacked plate heat exchanger set forth in claim 13 in which the turbulator members positioned in the flow course openings are of the same configuration.

16. The stacked plate heat exchanger set forth in claim 13 in which the turbulator members each comprise a grid of spaced peaks intervened by valleys.

17. The stacked plate heat exchanger set forth in claim 16 in which the turbulator peaks are arranged in parallel rows.

18. The stacked plate heat exchanger set forth in claim 17 in which the parallel rows of peaks are arranged in the direction of fluid flow in the flow course opening.

19. The stacked plate heat exchanger set forth in claim 17 in which the parallel rows of peaks are arranged crosswise to the direction of fluid flow in the flow course opening, the peaks having openings therein for communicating fluid flow therethrough from one to another of the valleys adjacent therewith.

20. The stacked plate heat exchanger set forth in claim 19 in which each peak has opposed sides containing openings, the openings at one side being offset positioned relative to those at the other side.

21. The stacked plate heat exchanger set forth in claim 18 in which the peaks are in the form of an inverted channel.

22. The stacked plate heat exchanger set forth in claim 18 in which the flow plates have readily visually discernible telltale means denotive of orientation placement of each relative to an alternate flow plate to effect the alternating communication of the flow course openings to the first and second fluid introduction means.

23. The stacked plate heat exchanger set forth in claim 22 in which the telltale means comprises margin notches in the plates.

24. The stacked plate heat exchanger set forth in claim 17 in which the turbulator peaks have openings therein establishing a communication path between the valleys at each side of a peak.

25. The stacked plate heat exchanger set forth in claim 1 in which at least one of said heat transfer plates is an elongated, generally rectangular-shaped, flat plate having two opposing pairs of openings therein, said flow plates also being elongated, generally rectangular-shaped, flat plates.

26. The stacked plate heat exchanger set forth in claim 25 in which at least one of said flow plates has an elongated laterally widened flow course opening therein and first and second openings therein, said elongated laterally widened flow course opening being in fluid communication with two of said openings within said at least one of said heat transfer plates and said first and second openings being in fluid communication, respectively, with the other two of said openings within said at least one of said heat transfer plates.

27. The stacked plate heat exchanger set forth in claim 26 wherein said flow plates each include a margin notch for providing visual means of orientation placement of said flow plates.

28. A method of fabricating a plate heat exchanger comprising:

providing flow plates having flow course openings therein;

providing heat transfer plates having fluid passage openings therein;

alternating the flow plates in a stacked relationship with the heat transfer plates to form a plurality of flow cavities defined by the surfaces of said heat transfer plates adjoining said flow plates and the walls of said flow plates defining said flow course openings;

positioning turbulator members in each of said flow cavities; and sealingly interconnecting the stacked plates to each other and said turbulator members to said heat transfer plates.

29. The method of claim 28 including the step of alternating the orientation of said flow plates, each of said flow plates having identically configured flow course openings.

30. The method of claim 28 wherein the turbulator members positioned in alternate flow cavities have the same configuration.

31. The method of claim 28 wherein the turbulator members positioned in alternate flow cavities have different configuration.

32. The method of claim 28 wherein the flow and heat transfer plates are provided as flat, generally rectangular components and are alternated in superposed relationship.

33. The method of claim 29 wherein each of said flow plates includes at least one marginal notch therein for indicating the orientations of the flow course openings therein.

* * * * *